United States Patent [19]

Gaudin

[11] 4,261,278

[45] Apr. 14, 1981

[54] GYRO-CONTROLLED PITCH STABILIZING SYSTEM

[76] Inventor: George C. Gaudin, 2772 Bayshore Dr., Newport Beach, Calif. 92660

[21] Appl. No.: 104,155

[22] Filed: Dec. 17, 1979

[51] Int. Cl.[3] ..... B63B 39/06

[52] U.S. Cl. ..... 114/126; 114/286

[58] Field of Search ..... 114/285, 286, 287, 275, 114/126, 276, 291, 277, 284

[56] References Cited

U.S. PATENT DOCUMENTS

| | | | |
|---|---|---|---|
| 1,335,893 | 4/1920 | Henry | 114/122 |
| 1,475,460 | 11/1923 | Thompson et al. | 114/122 |
| 1,795,346 | 3/1931 | Rebl | 114/291 X |
| 1,800,408 | 4/1931 | Schein | 114/126 |
| 2,099,380 | 11/1937 | Wallace | 114/122 |
| 2,099,492 | 11/1937 | Luders | 114/285 |
| 2,550,220 | 4/1951 | Bussei | 114/276 |
| 2,809,603 | 10/1957 | Bell | 114/122 |
| 2,890,673 | 6/1959 | Chadwick, Jr. | 114/122 |
| 2,923,874 | 2/1960 | Bell | 318/489 |
| 2,979,010 | 4/1961 | Braddon et al. | 114/126 |
| 2,987,027 | 6/1961 | Wanzer | 114/122 |
| 3,004,510 | 10/1961 | Nawara | 114/126 |
| 3,015,298 | 1/1962 | Bell et al. | 114/126 |
| 3,137,260 | 6/1964 | Harris, Jr. et al. | 114/275 |
| 3,225,728 | 12/1965 | Nomura et al. | 114/275 |
| 3,395,667 | 8/1968 | Kohman | 114/122 |
| 3,468,278 | 9/1969 | Kercheval | 114/286 |
| 3,469,550 | 9/1969 | Priestley | 114/275 |
| 3,520,265 | 7/1970 | Sanford | 114/285 |
| 3,611,971 | 10/1971 | Gwynn et al. | 114/126 |
| 3,727,572 | 4/1973 | Nelson | 114/126 |
| 3,738,304 | 6/1973 | Duberly | 114/126 |
| 3,760,759 | 9/1973 | Lang | 114/126 |
| 3,777,694 | 12/1973 | Best | 114/126 |

FOREIGN PATENT DOCUMENTS

| | | | |
|---|---|---|---|
| 940217 | 10/1963 | United Kingdom | 114/126 |

OTHER PUBLICATIONS

"Bennett Trim Planes", Bennett Marine Inc., 550 N.W. 12th Ave., Deerfield Beach, Florida 33441.

"Vosper Mini-fin Stabilizers", Vosper Thornycroft Ltd., Stabilizer Div., Northarbor Road, Cosham, Portsmouth, England P06 3TL.

"Naiad Small Ship Stabilizing System", Van Dusen and Meyer, Inc., Parrott Drive, P.O. Box 558, Shelton, CT 06484.

*Primary Examiner*—Sherman D. Basinger

*Attorney, Agent, or Firm*—Christie, Parker & Hale

[57] ABSTRACT

Pitch of a vessel is controlled by trim tabs mounted on the stern of the vessel. The trim tabs are hinged along an axis transverse to the fore-aft direction of the vessel. A hydraulic system changes the plane of the trim tabs in response to a gyro-controlled servo system that senses changes in the fore-aft level of vessel. The trim tabs operate dynamically to maintain the fore-aft level substantially constant or within limits that effectively moderate the pitching motion of the vessel.

10 Claims, 6 Drawing Figures

GYRO-CONTROLLED PITCH STABILIZING SYSTEM

FIELD OF THE INVENTION

This invention relates to ship stabilizing systems, and more particularly, to an arrangement for reducing the pitching motion of a vessel.

BACKGROUND OF THE INVENTION

Roll stabilizing systems are well-known which utilize fins projecting from the sides of the vessel below the water line to counteract the rolling action of the vessel due to wave action. The fins produce a counteracting moment by adjusting the angle of the fins relative to the water flowing past the fins as the ship moves through the water. However, stabilizing systems for reducing pitch have not been generally employed. While pitch stabilizing systems have been heretofore proposed, they have usually involved fins mounted adjacent the bow of the vessel to produce maximum effect. However, the fins located in the bow are subject to pounding forces in heavy seas when the bow lifts out of the water. It has been difficult to provide fins of sufficient size to control pitching motion which could also be made sufficiently strong to withstand the pounding action of the bow lifting free of the water and then plunging back into the water, as the level of the water rises and falls in relation to the bow of the ship. The use of stabilizing fins mounted nearer the stern for stabilizing pitch has also heretofore been proposed. For example, in U.S. Pat. No. 3,760,759 there is described a system for controlling both pitch and roll by a single set of fins positioned toward the stern of the vessel. Because such fins project out from the sides of the vessel, they must be supported in cantilever fashion, which means the fins must be made relatively thick, increasing their drag. The fins, because they project outwardly of the vessel, are subject to damage, particularly during docking of the vessel. The counteracting force of the fins, furthermore, is derived entirely from the forward movement of the vessel through the water, limiting their effectiveness at reduced speeds.

SUMMARY OF THE INVENTION

The present invention is directed to an improved pitch stabilizing system which utilizes fins mounted at the stern of the vessel and hinged at their leading edge. The hull of the vessel upon which the fins are mounted is adapted to float on the water surface and be predominantly buoyantly supported at all operating speeds, and the stern of this hull normally extends below the at-rest even-keel load waterline. The fins operate as trim tabs for lifting and lowering the stern to change the running trim (steady-state horizontal attitude) of the vessel. A gyro sensor is used as a reference in a servo control system which, through a hydraulic drive, dynamically adjusts the angle of the fins to counteract the change of attitude due to pitching motion of vessel. The fins are positioned aft of the propellers to take advantage of the flow of water produced by the thrust of the propellers to enhance the lifting action of the fins. The fins extend substantially across the full width of the hull, and support means for the fins is located at least adjacent both the inboard and outboard ends of each fin.

DESCRIPTION OF THE DRAWINGS

For a more complete understanding of the invention reference should be made to the accompanying drawings, wherein.

DETAILED DESCRIPTION

Figures 1, 2:
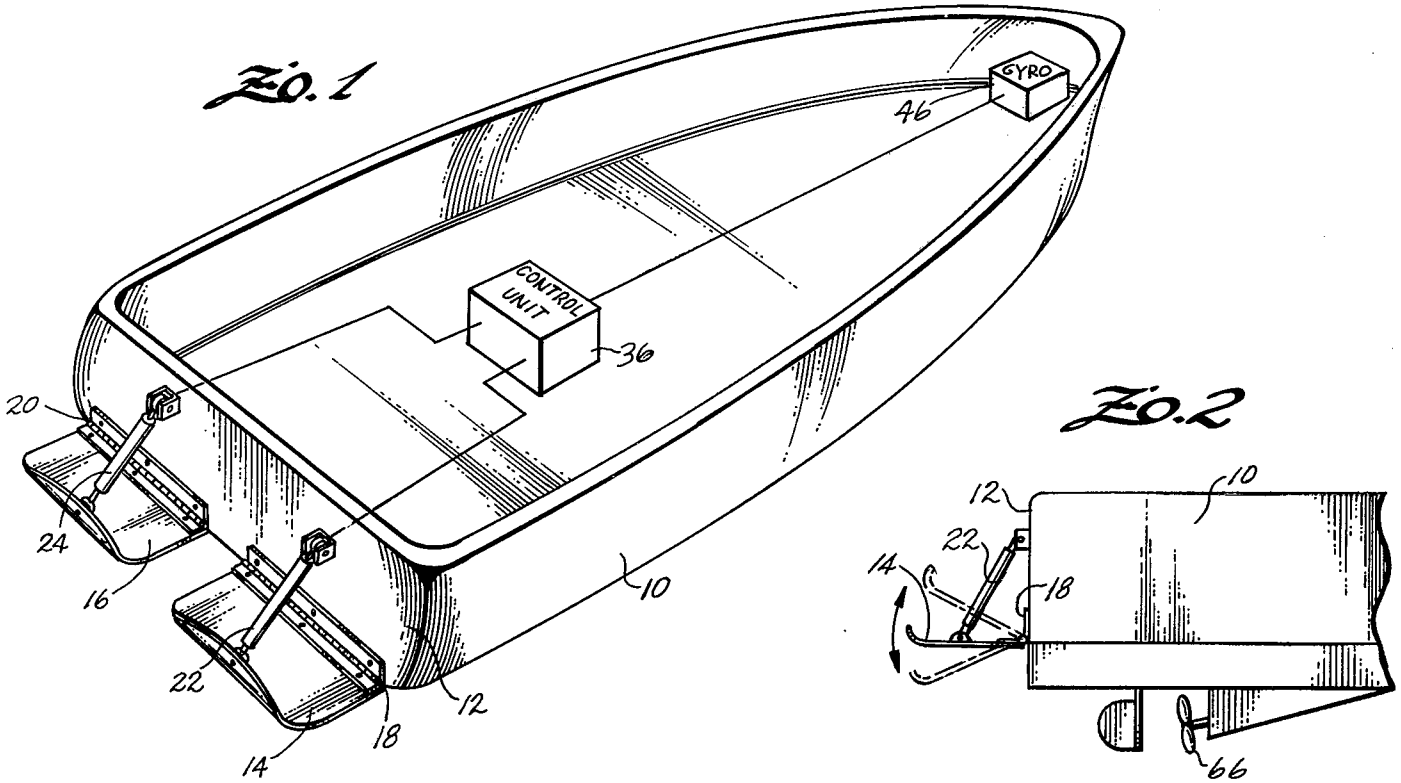
FIG. 1 is a perspective view of a vessel incorporating the present invention.
FIG. 2 is a partial side elevational view of the stern portion of the vessel FIG. 1.

Referring to the embodiment of FIGS. 1 and 2, there is shown a vessel 10 of the type having a square transom 12, such is common in smaller to medium sized yachts, for example. A pair of trim tabs 14 and 16 are mounted on the transom 12 below the waterline by hinge supports 18 and 20, respectively. The trim tabs project rearwardly from the transom in substantially a horizontal plane. However, the plane of the trim tabs is adjustable by hydraulic actuators 22 and 24, respectively. The hydraulic actuators are controlled by a hydraulic drive operated by a gyro stabilizer servo control.

Figure 3:
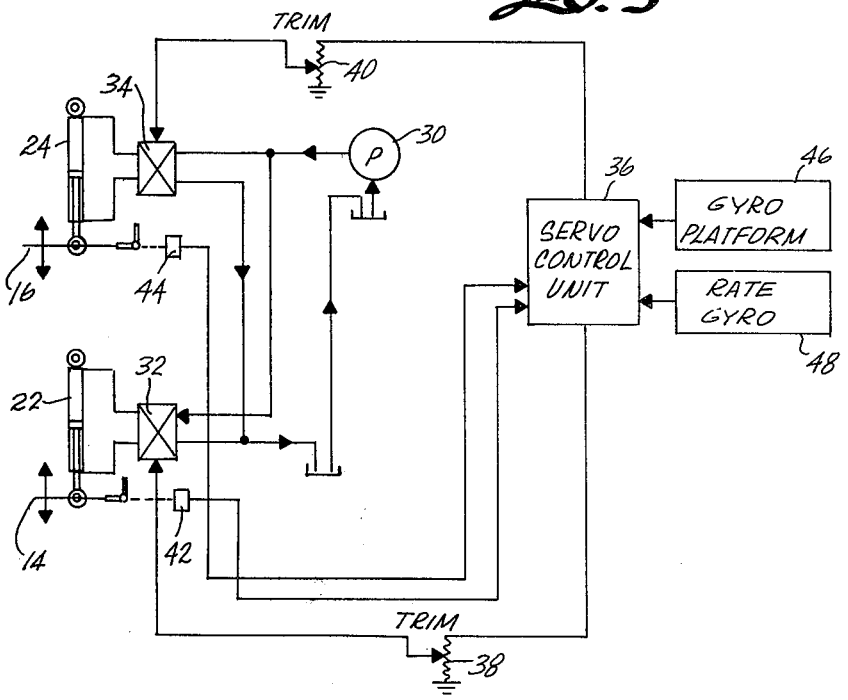
FIG. 3 is a schematic diagram of the control circuit of the present invention.

A suitable hydraulic drive and servo control of conventional design are shown by way of example in more detail in FIG. 3. A hydraulic pump 30 is used to operate the actuators 22 and 24 through servo-operated valves 32 and 34, which control both the direction and rate of feed of hydraulic fluid from the pump 30 to either end of the hydraulic actuators 22 and 24. The servo valves 32 and 34 are controlled electrically from a servo control unit 36. The signal from the servo control unit 36 to the respective valves may be adjustable by trim control potentiometers 38 and 40, which permit separate adjustment of the average angle of the trim tabs to correct for any undesired steady-state running trim in the vessel.

The servo control unit 36 responds to feedback signals derived from position sensors 42 and 44 linked to the trim tabs 14 and 16. The sensors can be either controlled mechanically by a linkage to the trim tabs, or can be controlled hydraulically by the output of the servo valves 32 and 34. The sensors provide a position feedback signal to the servo control unit 36. Other inputs to the servo control unit are derived from a stable gyro platform 46, for example, which provides a fixed reference by which changes in attitude of the vessel can be determined. Thus the gyro platform 46 provides a signal to the servo unit indicating any change in the attitude of the vessel about a horizontal transverse axis as it experiences a pitching motion. An additional input to the servo control unit may be derived from a rate gyro 48. The rate gyro can be used in conventional manner to generate both angular velocity and acceleration components of the vessel's motion relative to the pitch axis of the vessel. The displacement signal from the gyro platform is used in combination with the velocity and acceleration signals derived from the rate gyro to control the angular position of the trim tabs 14 and 16 in a manner to reduce the fore-aft pitching motion of the vessel by the counteracting force of the trim tabs. Thus as the bow of the vessel begins to rise, the servo operates the trim tabs to lower the trailing edges. Water flowing beneath the vessel strikes the inclined surface of the trim tabs producing an upward thrust which lifts the stern, thereby counteracting the upward thrust of the bow about the pitch axis which is located intermediate the length of the vessel. As the bow drops, the angle of the trim tabs is changed by raising the trailing edges and reducing the upward thrust of the trim tabs. In fact, as the trailing edges are raised, there is sufficient water reaction against the upper surface of the trim tabs to force the stern of the vessel down to counteract the lowering of the bow by the pitching motion of the vessel. Thus the servo control unit operates the trim tabs in response to the pitching motion of the vessel to provide a couple about the pitch axis counter to the couple inducing pitching motion. The result is to reduce the normal pitching motion of the vessel.

Figure 4:
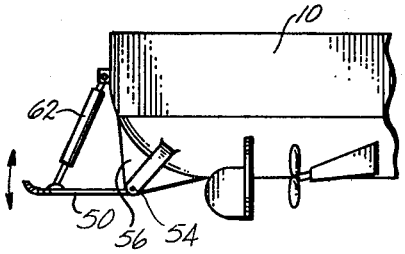
FIG. 4 is a partial elevational view of the stern portion of a vessel having an alternative embodiment of the present invention.
Figure 5:
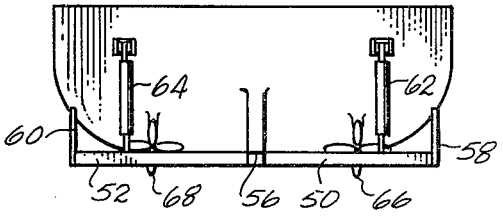
FIG. 5 is a stern view of the embodiment of FIG. 4.

An alternative arrangement is shown in FIGS. 4 and 5, which is suitable for vessels having a rounded stern. In the arrangement of FIGS. 4 and 5, a pair of trim tabs 50 and 52 are supported along their leading edges by a shaft 54. The shaft is supported at its center by a keel 56 projecting below the curve of the stern. The outer ends of the shaft 54 are journaled in support arms 58 and 60 rigidly secured to the bottom of the vessel. As in the arrangement of FIGS. 1–3, the trim tabs 50 and 52 are individually rotated about the shaft 54 by suitable hydraulic actuators 62 and 64. While hydraulic actuators have been shown, other types of drive systems may be used, such as electric motors, or the like.

The shaft 54 with trim tabs 50 and 52 is preferably positioned directly in line with the twin drive screws of the vessel indicated at 66 and 68. Twin rudders may be interposed between the position of the drive screws and the shaft 54. The trim tabs are centered laterally in relation to the two drive screws.

The arrangement of FIGS. 4 and 5 operates in the same manner as the system described in connection with FIGS. 1–3. The embodiment of FIGS. 4 and 5 has the additional advantage that the water thrust to the rear by the drive screws results in higher velocity of the impinging water than the movement of the vessel through the water alone can produce. Thus the drive screws provide an additional force to the water against the surfaces of the trim tabs, resulting in a greater vertical component of force for counteracting the pitching motion of the vessel. Since water flow across both the top and bottom surfaces of the trim tab is provided by the wake from the adjacent drive screw, greater pitch compensating forces can be generated for a given forward velocity of the vessel as compared to the arrangement of FIGS. 1–3.

Also, as with the embodiment shown in FIGS. 1 and 2, trim tabs 50 and 52 can be operated differentially to counteract roll as well as pitch. Signals useful to counteract roll can be supplied to servo control unit 36 from a roll gyro platform and a roll rate gyro for addition to or subtraction from the signals from platform 46 and pitch rate gyro 48, as appropriate.

Figure 6:
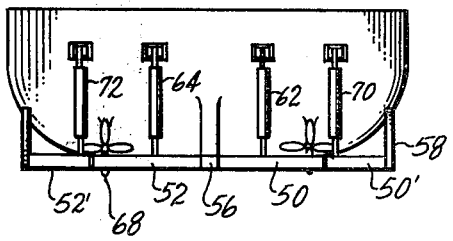
FIG. 6 is a stern view of a vessel incorporating a further embodiment of the invention.

An alternative arrangement is shown in FIG. 6 in which both roll and pitch are controlled separately, and is a modification to the arrangement of FIGS. 4 and 5. The trim tabs 50 and 52 are split into two sections. Inboard sections 50 and 52 are operated as a unit to control pitch in the manner described above and still extend laterally through the wake of the propellers. The outboard sections 50' and 52' are operated independently by additional hydraulic actuators 70 and 72. The outboard actuators are used to control the outer trim tab sections 50' and 52' to counteract roll. A conventional roll stabilizer control (not shown) is used to sense roll motion and operate the actuators 70 and 72 in a manner to produce a couple about the fore-aft axis that is in opposition to the rolling motion of the vessel.

It will be noted in all the arragements described, the trim tabs are located at the stern of the vessel within the beam of the vessel so as to be well protected from damage by pilings or other docking structure. The trim tabs, in addition to providing dynamic correction for pitching motion, still provide their function of adjusting the trim of the vessel both laterally and fore and aft.

What is claimed is:

1. Apparatus for reducing pitching motion of a moving vessel driven by one or more screws in the stern of the vessel, comprising:

a hull adapted to float on the surface and to be at least predominantly buoyantly supported at all operating speeds and be subjected to pitching action from surface waves, the hull having a stern portion that normally extends below the at-rest even-keel load waterline, stabilizing fin means extending across the stern of the hull substantially the full beam width of the hull, means secured to the stern of the hull and the fin means for rotatably supporting the fin means at the stern of the hull, said means supporting the fin means being anchored to the hull at positions adjacent the outboard ends of the fin means and providing rotation of the fin means about a substantially horizontal axis transverse to the vessel, the fin means being positioned aft of the screws, drive means rotating the fin means about the axis of the hinge means to change the angle of attack of the fin means as it moves through the water, and means sensing changes in the pitch of the vessel for actuating the drive means to reduce the pitching motion of the hull.

2. Apparatus of claim 1 wherein at least a portion of the fin means is within the discharge water stream of a screw.

3. Apparatus of claim 1 wherein the hinge means is secured below the waterline of the hull to permit water to flow over both the top and bottom surfaces of the fin.

4. Apparatus of claim 1 wherein the vessel has a transom and the hinge means is secured to the transom with the axis of the hinge between the waterline and the bottom of the transom, the fin means projecting rearward of the transom.

5. Apparatus of claim 1 wherein said fin means includes a plurality of separately movable sections rotating about a common hinge axis, drive means for rotating each of said sections, the pitch sensing means actuating each of the drive means as a unit to reduce the pitching motion of the vessel, and means for separately positioning each section to adjust for steady-state trim of the vessel.

6. An anti-pitch stabilizer for reducing pitching motion of a moving vessel moved through the water by screw means comprising:

a hull adapted to float on the surface at all operating speeds and be subjected to pitching action from surface waves, a plurality of individual trim tabs, hinge means securing the trim tabs to the hull adjacent the stern below the waterline of the hull and aft of the screw means, the hinge means being supported from the hull at laterally spaced positions adjacent the outboard ends of the trim tabs, the trim tabs being individually tiltable about a substantially common hinge axis extending laterally of the vessel, the combined lateral width of the trim tabs being substantially the same as the width of the vessel, means mounted in the vessel for generating a signal indicating changes in the fore-aft pitch angle of the hull, drive means responsive to said signal for tilting the trim tabs as a unit in response to changes in pitch angle to stabilize the pitching motion of the vessel.

7. Apparatus of claim 6 further including means for individually setting the angles of the trim tabs about said horizontal axis to adjust the trim of the vessel.

8. Apparatus of claim 6 wherein the trim tabs are hinged along the leading edge whereby the trailing edge of the trim tabs are raised and lowered by the drive means.

9. Apparatus of claim 6 wherein the hinge means is secured below the bottom of the vessel to permit water to flow over both the top and bottom surfaces of the trim tabs.

10. Apparatus of claim 6 wherein the vessel has a transom and the hinge means is secured to the transom with the hinge axis substantially at the bottom of the transom, the trim tabs projecting rearward of the transom.

* * * * *